US008650681B2

(12) United States Patent
Masoncup

(10) Patent No.: US 8,650,681 B2
(45) Date of Patent: Feb. 18, 2014

(54) BED SKIRT WITH MITERED CORNER, CLOSED PLEAT, AND CAP CONSTRUCTION, AND METHOD OF MANUFACTURE

(76) Inventor: John F. Masoncup, Mount Prospect, IL (US)

( * ) Notice: Subject to any disclaimer, the term of this patent is extended or adjusted under 35 U.S.C. 154(b) by 0 days.

(21) Appl. No.: 13/534,303

(22) Filed: Jun. 27, 2012

(65) Prior Publication Data

US 2014/0000029 A1 Jan. 2, 2014

(51) Int. Cl.
*A47C 21/00* (2006.01)

(52) U.S. Cl.
USPC ..... 5/493; 5/498

(58) Field of Classification Search
USPC ..... 5/488, 493, 498, 499, 658, 659, 663, 5/482
See application file for complete search history.

(56) References Cited

U.S. PATENT DOCUMENTS

| | | | | | |
|---|---|---|---|---|---|
| 2,245,779 | A | | 6/1941 | Heil | |
| 2,641,001 | A | | 6/1953 | Krasnov | |
| 3,243,827 | A | * | 4/1966 | Kintner | 5/496 |
| 3,694,832 | A | * | 10/1972 | Jamison | 5/497 |
| 3,999,233 | A | * | 12/1976 | Morris | 5/493 |
| 4,045,832 | A | * | 9/1977 | DiForti et al. | 5/496 |
| 4,095,300 | A | * | 6/1978 | Ruben | 5/502 |
| 4,141,097 | A | * | 2/1979 | Levinsohn et al. | 5/493 |
| 5,086,531 | A | | 2/1992 | Carlos | |
| 5,353,456 | A | | 10/1994 | Evans | |
| 5,621,931 | A | | 4/1997 | Hamilton | |
| 5,638,562 | A | | 6/1997 | Masoncup | |
| 5,715,553 | A | | 2/1998 | Baron et al. | |
| 5,733,397 | A | | 3/1998 | McDaniel | |
| 5,946,751 | A | | 9/1999 | DeMay | |
| 6,035,469 | A | | 3/2000 | Schrougham | |
| 1,197,290 | A | | 9/2000 | Masoncup | |
| 6,151,731 | A | | 11/2000 | Saparow | |
| 6,276,009 | B1 | * | 8/2001 | Schrougham | 5/493 |
| 6,598,249 | B2 | * | 7/2003 | Pajanacci et al. | 5/493 |
| 6,912,745 | B2 | | 7/2005 | Masoncup | |
| 6,971,129 | B2 | | 12/2005 | Wootten, Jr. et al. | |
| 7,089,611 | B1 | | 8/2006 | Jones et al. | |
| 7,676,863 | B2 | | 3/2010 | Henning | |
| D634,146 | S | | 3/2011 | Kennett | |
| D634,958 | S | | 3/2011 | Burgio-Timmany | |
| 2004/0231053 | A1 | * | 11/2004 | Masoncup | 5/493 |
| 2007/0022534 | A1 | | 2/2007 | Richards | |
| 2007/0056099 | A1 | | 3/2007 | Langenberger | |
| 2011/0167561 | A1 | | 7/2011 | Gatzke et al. | |
| 2011/0302715 | A1 | | 12/2011 | Battaglia et al. | |
| 2011/0308013 | A1 | * | 12/2011 | Kennett | 5/493 |

FOREIGN PATENT DOCUMENTS

| | | | | |
|---|---|---|---|---|
| WO | WO 2010091482 A1 | * | 8/2010 | A47C 31/10 |

* cited by examiner

*Primary Examiner* — William Kelleher
*Assistant Examiner* — Richard G Davis
(74) *Attorney, Agent, or Firm* — Meroni & Meroni, P.C.; Charles F. Meroni, Jr.; Christopher J. Scott

(57) ABSTRACT

A bed skirt construction is formed from a singular fabric panel. The fabric panel comprises a top edge and opposed sets of opposed corner edging extending from the top edge into the width. The sets of opposed corner edging are respectively fastened together for forming corner seams, which seams bound opposed upper side panel portions from an upper foot panel portion. The seams terminate at a pair of corner vertices having a foot panel crease extending therebetween for bounding the upper foot panel portion from a lower foot panel portion. First and second side panel creases extend from the corner vertices orthogonal to the foot panel crease for bounding upper and lower side panel portions. Mitered corner joints, pleats, and a cap assembly together function to enhance positioned placement of the bed skirt construction upon the box spring.

19 Claims, 7 Drawing Sheets

11
12
13
14
20
21
22
25(I)
25(R)
25
26
27
28
29
30
32
35
37
39
40
42
43
46
A

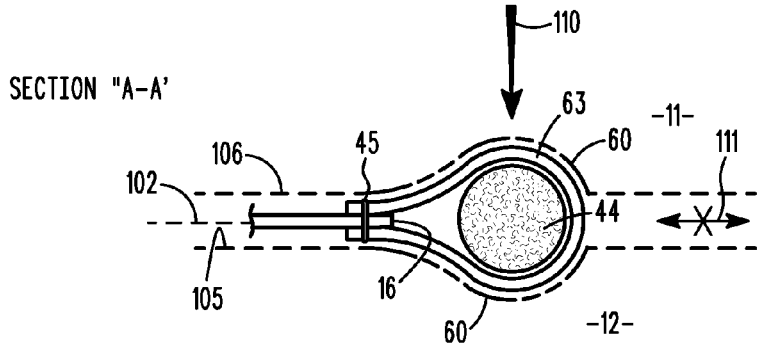
FIG. 1(c)
FIG. 2(a)
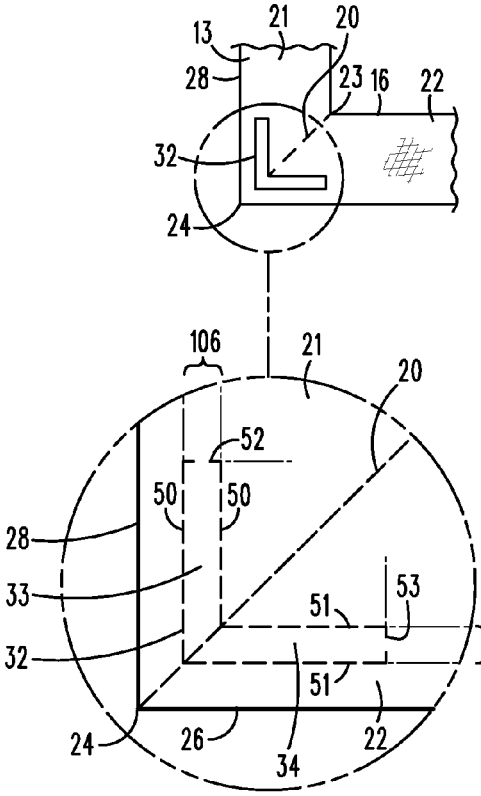
FIG. 2(b)
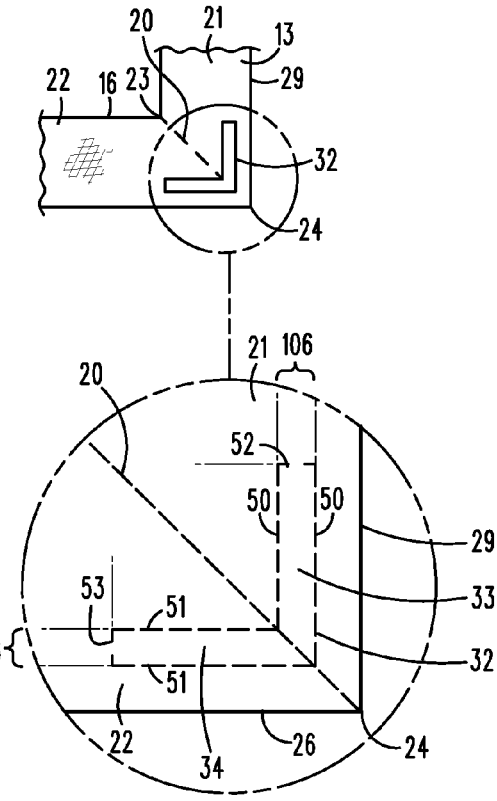
FIG. 2(c)
FIG. 2(d)

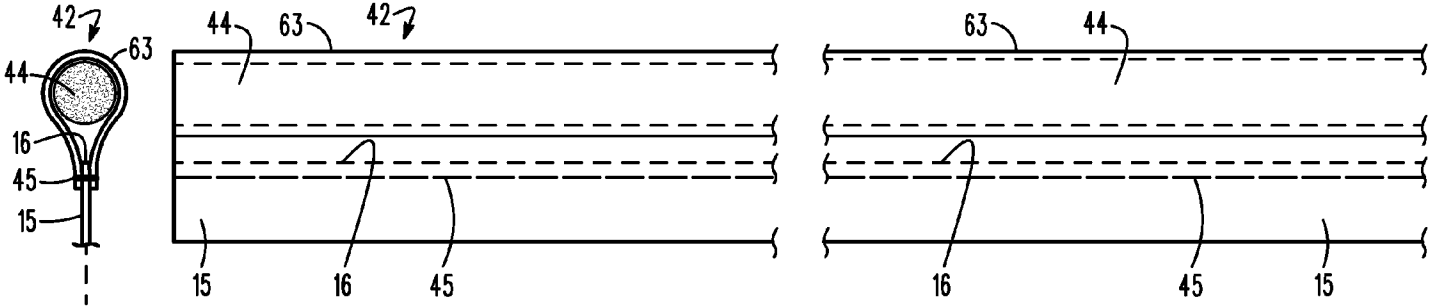
FIG. 3
FIG. 3(a)
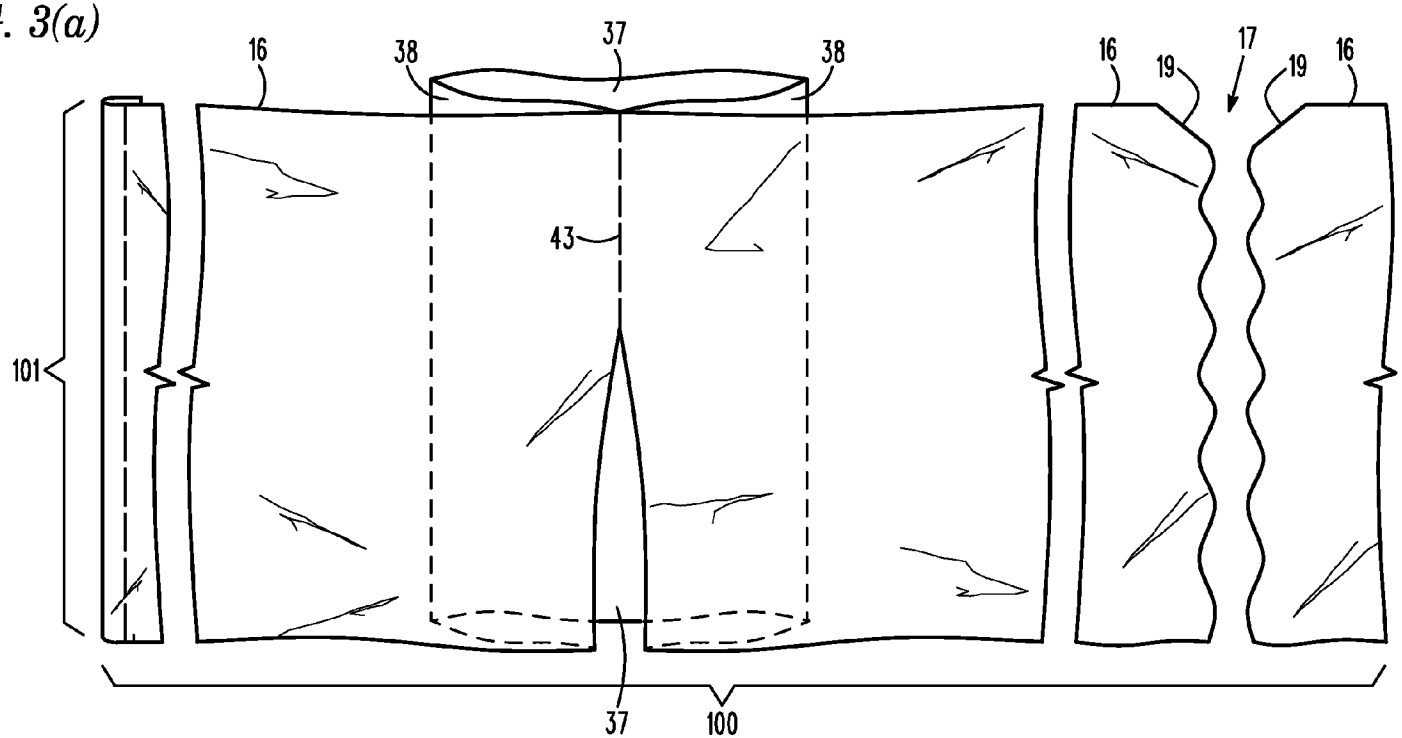
FIG. 4

BED SKIRT WITH MITERED CORNER, CLOSED PLEAT, AND CAP CONSTRUCTION, AND METHOD OF MANUFACTURE

BACKGROUND OF THE INVENTION

1. Field of the Invention

The present invention relates generally to bed skirts, and more particularly relates to a bed skirt construction having mitered corner construction, Stay Perfect partially closed, partially open pleat construction, and a capping or tuck/welt assembly construction for enhancing the fit of the bed skirt at the corner sites, for enhancing tuck positioned placement of the skirt intermediate a mattress and a box spring, and for enhancing linearity of the fold lines between upper tucked portions and lower draping portions of the bed skirt as outfitted upon a bed assembly.

2. Description of the Prior Art

Bed skirts have been used for many years for covering the box spring portion of a bed assembly to provide an aesthetically pleasing appearance to the bed assembly. Typically, bed skirts have an upper platform or mattress-to-spring interface portion that is placed over the top of the box spring and a lower panel portion connected to the interface portion that hangs over the sides of the box spring to conceal the box spring from view and prevent debris from entering the space under the box spring.

A basic bed skirt construction comprises a decorative length of fabric that surrounds the box spring element of a bed assembly (basically comprising a mattress and a box spring). The length of fabric surrounds three sides of the box spring, including the left and right sides and the foot. The head is not surrounded by a bed skirt as would normally be the case with a dust ruffle. Some of the more pertinent prior art disclosures relating to bed skirt constructions in connection with the present invention are briefly described hereinafter.

U.S. Pat. No. 5,353,456 ('456 patent), which issued to Evans, for example, discloses a Height-Adjustable Bedskirt Assembly. The '456 patent describes a height-adjustable bed skirt assembly comprising a generally rectangular support sheet having fasteners for adjustably coupling together a longitudinal fold in the sheet surface, and an elongate skirt.

The support sheet includes fasteners which extend along the perimeter margin and engage similar fasteners which extend along the upper margin of the skirt, to permit easy removability of the skirt while the support sheet remains in place beneath the mattress. The support sheet includes a plurality of rows of spaced fasteners for adjustably coupling together a pair of longitudinal folds in the sheet surface. The support sheet also includes elastic keepers adjacent the corners for securing the support sheet to an underlying box spring.

U.S. Pat. No. 5,621,931 ('931 patent), which issued to Hamilton, discloses a Mattress Stabilizing Bedskirt Assembly Having Detachably Attachable Skirt Components The '931 patent describes a bed skirt assembly made up of a non-slip grip deck made from non-slip fabric with releasable fasteners. The grip deck is installed between the mattress and box springs of the bed and stabilizes the location of the mattress relative to the box springs and provides for easy attachment of segments of skirting, in one panel or several panels. The position of the panels is adjustable for height and length and to suit individual bed frames. The skirt panels can be quickly and easily removed and replaced without having to remove the mattress from the box springs.

U.S. Pat. No. 5,715,553 ('553 patent), which issued to Baron et al., discloses a System Bed Skirt. The '553 patent describes a bed skirt for use over the lower part of a bed having a foot and opposed spaced sides and a horizontally extending mattress supported on a bedstead formed by a frame and legs, said bed skirt extending over the legs of the bed to provide a desired enclosure for the lower portion of the bed to minimize dust accumulations under the bed and to provide a decorative enclosure for the lower part of the bed.

The bed skirt is formed with a vertically extending skirt portion or flounce dimensioned to extend along at least the foot and opposed sides of the bed from a point close to the floor to a point above the legs of the bed. Secured to the top edge of the skirt by a single continuous line of stitching is a retaining strip which extends horizontally from the upper edge of the skirt portion over at least a part of the bed frame, preferably a distance such as to cover the edge of the horizontal surface of the mattress support.

A plurality of spaced complementary fastening elements of a hook and loop type of fastening element are secured to the retaining strip therealong and a plurality of mating complementary fastening elements of said hook and loop type of fastening elements are provided adhesively securable to a horizontal surface of the bed frame, preferably the mattress support, at points such that the spacing of said fastening elements on the horizontal surface of the bed frame matches the spacing of the hook and loop elements secured to said retaining element, whereby said retaining element and its associated skirt portion may be selectively positioned along the side and bottom edges of the bed and held in this preselected position.

U.S. Pat. No. 6,035,469 ('469 patent), which issued to Schrougham, discloses a Bed Skirt. The '469 patent describes a bed skirt having a downwardly extending ruffle and panel sections that are tucked between an upper and lower mattress to maintain such bed skirt in a proper position and alignment with respect to the lower mattress.

The panels sections are equipped with adjustable fastening implements that are used to secure the positioning of the panel sections with respect to each other. The panel sections are designed to be incrementally inserted between an upper and lower mattress, and the fastening implements allow a user to secure the panel sections in proper alignment with respect to each other and with respect to the lower mattress once inserted and positioned thereupon.

U.S. Pat. No. 6,276,009 ('009 patent), which issued to Schrougham, discloses a Bed Skirt. The'009 patent describes a bed skirt having a downwardly extending ruffle and panel sections that are tucked between an upper and lower mattress to maintain such bed skirt in a proper position and alignment with respect to the lower mattress.

The panel sections are discontinuous or partially discontinuous and are equipped with adjustable fasteners that are used to secure the positioning of the panel sections with respect to each other. The panel sections are designed to be incrementally inserted between an upper and lower mattress, and the fasteners allow a user to secure the panel sections in proper alignment with respect to each other and with respect to the lower mattress once inserted and positioned between the mattresses.

U.S. Pat. No. 6,912,745 ('745 patent), which issued to Masoncup, discloses a Bed Skirt and Methods of Manufacture and Use. The '745 patent describes a bed skirt for positioned placement between a mattress and a box spring of a bed. The bed skirt has a side fabric panel for covering a first side of the box springs with a corner cap fold at one end for covering a corner of the box springs during use. A foot fabric panel covers a second side of the box springs perpendicular to the first side of the box springs.

A fabric cap connects an edge of the first panel to an edge of the second panel adjacent the corner cap of the first panel providing a convertible corner allowing the corner cap to optionally cover a corner of the box springs during use or straddle a bed frame member during use. A cord within the fabric cap frictionally holds the side panel and foot panel in place between the box springs and the mattress during use.

U.S. Pat. No. 6,971,129 ('129 patent), which issued to Wootten Jr., et al., discloses an Adjustable Bed Skirt. The '129 patent describes an adjustable bed skirt, for use with a bed having a mattress and a box spring, includes side panels having a non-slip portion, and end panels also including a non-slip portion. By inserting the non-slip portion of each side panel and each end panel between the mattress and the box spring, the side and end panels are retained in position so that the remaining non-inserted portion of each of the side and end panels hangs adjacent the box spring and forms a bed skirt thereon. Caps including a non-slip portion may also be inserted between the mattress and the box spring, adjacent edges of the box spring, to hide any gaps between edges of the side and end panels. The bed skirt may also be used with a bed having a mattress placed on a frame, and supported between the mattress and the frame.

It will be seen from an inspection of the prior art that the prior art perceives a need for a bed skirt construction comprising mitered corners for enhancing the fit of the bed skirt at the left and right foot corners. The corners of a typical bed box spring are created by changing the side line construction, at predetermined points, by 90 degrees, thereby forming a corner. Bed skirt construction has heretofore not adequately addressed the 90 degree corners of a box spring and how to enhance maintenance of the skirt planes at the corner junctions. The prior art thus perceives a need for mitered corner bed skirt construction according to the present invention as summarized in more detail hereinafter.

SUMMARY OF THE INVENTION

To achieve these and other readily apparent objectives, the present invention essentially provides a bed skirt construction with mitered corners. The bed skirt construction according to the present invention is designed for use with a bed having a mattress and a box spring. An upper portion of the bed skirt construction is tucked or sandwiched between the mattress and box spring, allowing a lower portion of the bed skirt construction to drape over the box spring.

The bed skirt construction is constructed from a fabric panel of predetermined length and width. The fabric panel comprises a top edge and pair of isosceles triangular cutouts extending into the width from the top edge. Each cutout defines obliquely opposed edges, which edges are stitched to form corner seams for forming opposed upper side panel portions and an upper foot panel portion.

The bed skirt construction may be outfitted upon a box spring such that lower side panel portions conceal side portions of the box spring, and a lower foot panel portion conceals a foot portion of the box spring. Further, the upper side panel portions and the upper foot panel portion extend in a mattress-to-spring interface plane in superior adjacency to the box spring and in inferior adjacency to the mattress.

A number of features central to the practice of the bed skirt construction include mitered joints, so-called Stay Perfect pleats, and certain capping means. Mitered joints or corners help form perfectly orthogonal corners at the foot portion of the bed skirt construction. It is contemplated that the mitered corners or joints according to the present invention essentially function to enhance positioned placement of the bed skirt construction upon a box spring.

Corner pleats extend downwardly from the mitered joints. The corner pleats are formed by gathering material of the fabric panel in folds and forming the mitered joint via stitching through the folds. The lower side panel portions and the foot panel portion also preferably comprise at least one pleat. Each pleat comprises a closed upper pleat terminus, which upper pleat termini respectively terminate in the crease lines. In combination with the mitered corners, the pleats, having a closed upper portion (for horizontal sandwiched or tucked placement intermediate the mattress and the box spring) and an open lower portion (for vertical draping placement exterior to the box spring) bound by the crease line essentially function to enhance positioned placement of the bed skirt construction atop the box spring.

The bed skirt construction may further comprise a cap assembly or tuck/grip welt assembly. The cap assembly or capping means preferably comprises a fabric fold and a cord member receivable in the fabric fold. The fabric fold is stitched to the top edge thereby forming a top edge terminus at the upper side panel portions and the upper foot panel portion. The cap assembly, mitered corners or joints, and Stay Perfect pleats together enhance positioned placement of the bed skirt construction atop the box spring.

In this last regard, it is contemplated that an essential or primary feature of the subject invention is to provide a bed skirt that outfits a box spring so as to have or form perfect fold lines, tuck portions, and corner construction. Such a bed skirt is needed insofar as the prior art perceived a need for a bed skirt that requires minimal maintenance for enhancing the form and function of a bed skirt, namely to maintain fabric panel portions in orthogonal planar relationships to one another for both aesthetic and functional enhancements.

BRIEF DESCRIPTION OF THE DRAWINGS

Other features of my invention will become more evident from a consideration of the following brief description of patent drawings:

FIG. 1(*a*) is an enlarged, fragmentary sectional view of a side pleat section of the bed skirt construction according to the present invention as sectioned from FIG. 1.

FIG. 1(*b*) is an enlarged, fragmentary first sectional view of a corner pleat section of the bed skirt construction according to the present invention as sectioned from FIG. 1.

FIG. 1(*c*) is an enlarged, fragmentary sectional view of a cap assembly of the bed skirt construction according to the present invention as sectioned from FIG. 1.

FIG. 2(*a*) is a first fragmentary top view of a first mitered corner site of the bed skirt construction according to the present invention.

FIG. 2(*b*) is a first fragmentary top view of a second mitered corner site of the bed skirt construction according to the present invention.

FIG. 2(*c*) is a second, enlarged fragmentary top view of the first mitered corner site otherwise depicted in FIG. 2(*a*).

FIG. 2(*d*) is a second, enlarged fragmentary top view of the second mitered corner site otherwise depicted in FIG. 2(*b*).

FIG. 3 is a side view depiction of a length of the cap assembly incorporated into the bed skirt construction according to the present invention.

FIG. 3(*a*) is a sectional end view depiction of the cap assembly incorporated into the bed skirt construction according to the present invention.

FIG. 4 is a side view depiction of a first length of the primary fabric panel used to construct the bed skirt construction according to the present invention showing, from left to right, an end section, a side panel pleat section, and fragmentary first and second portions of a corner section.

DETAILED DESCRIPTION OF THE PREFERRED EMBODIMENT

Figures 1, 1A, 1B:
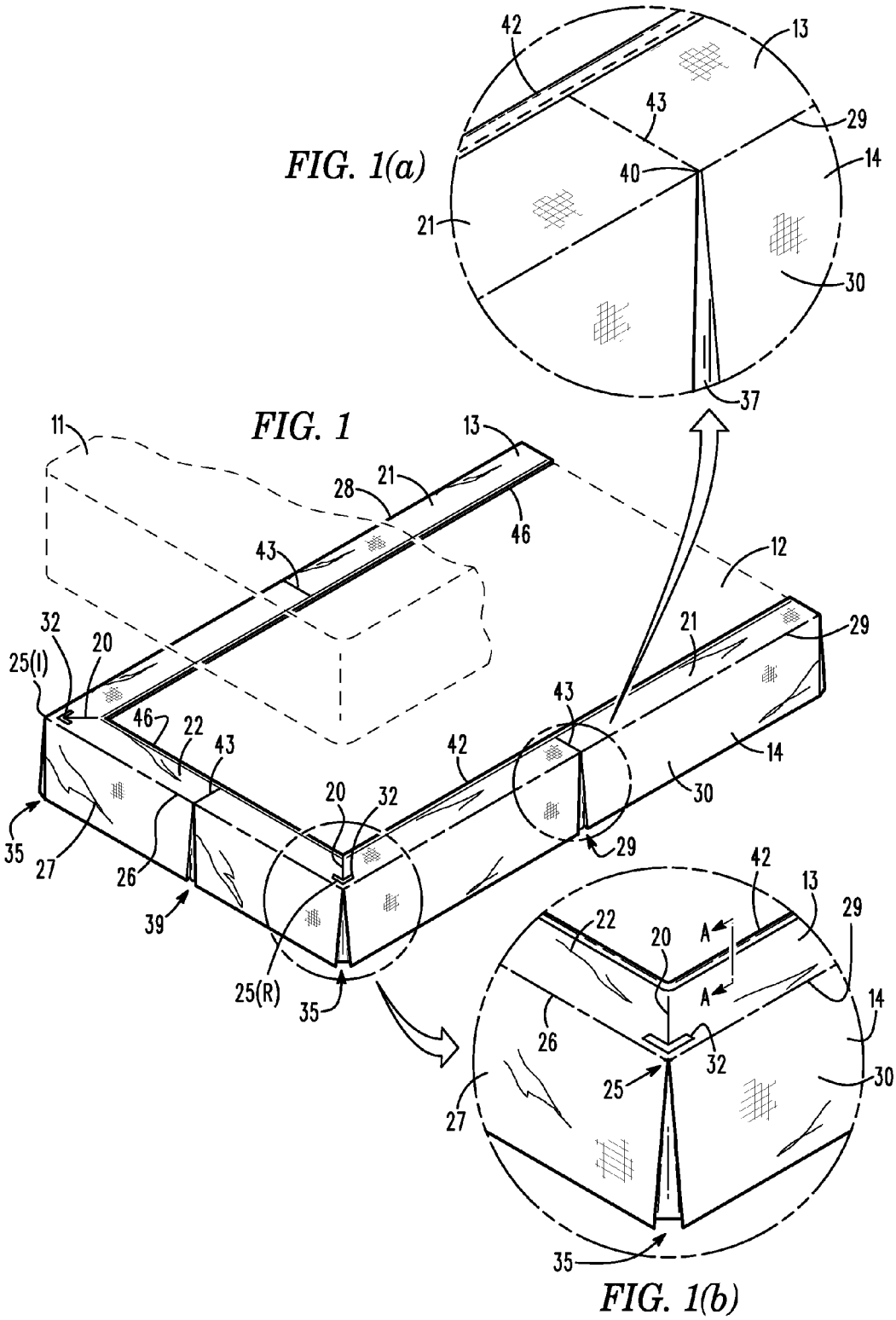
FIG. 1 is a top perspective view of the bed skirt construction according to the present invention shown outfitted upon a box spring with a fragmentary, phantom mattress exploded from the bed skirt construction.

Referring now the drawings with more specificity, the present invention provides a bed skirt construction 10 and associated method of manufacture. The bed skirt construction 10 according to the present invention is designed to be used with a bed assembly basically having a mattress as at 11 and a box spring as at 12. A top or interface portion of the bed skirt construction 10 is tucked or sandwiched between the mattress 11 and box spring 12, allowing a lower portion 14 of the bed skirt construction 10 to drape over the box spring 12 as it falls to the floor as generally depicted in FIG. 1.

Figure 5:
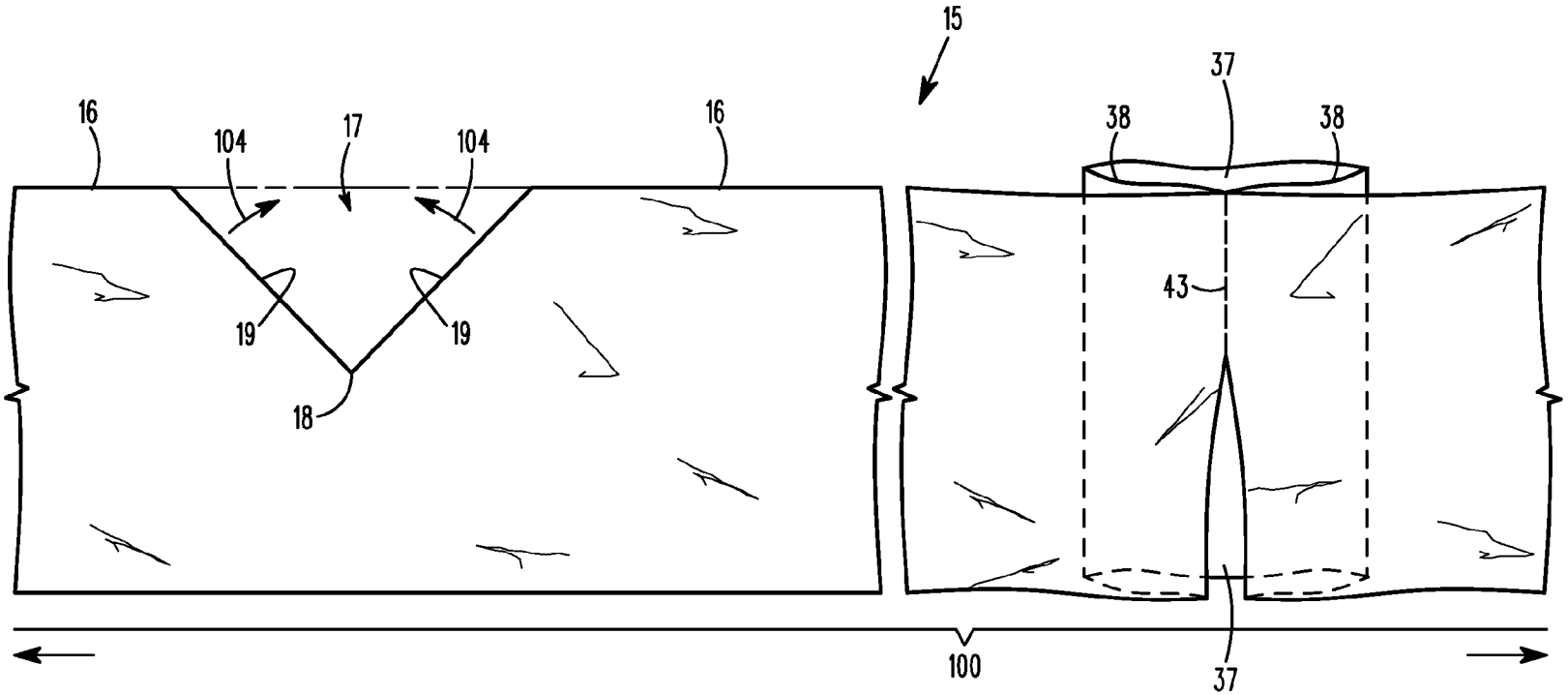
FIG. 5 is a side view depiction of a second length of the primary fabric panel used to construct the bed skirt construction according to the present invention showing, from left to right a corner section and a foot panel pleat section.
Figure 6:
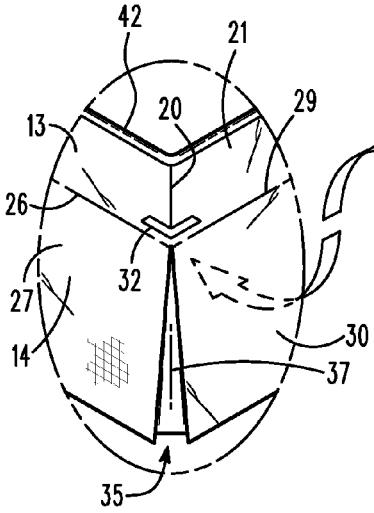
FIG. 6 is a fragmentary second sectional view of a corner pleat section of the bed skirt construction according to the present invention.
Figure 7:
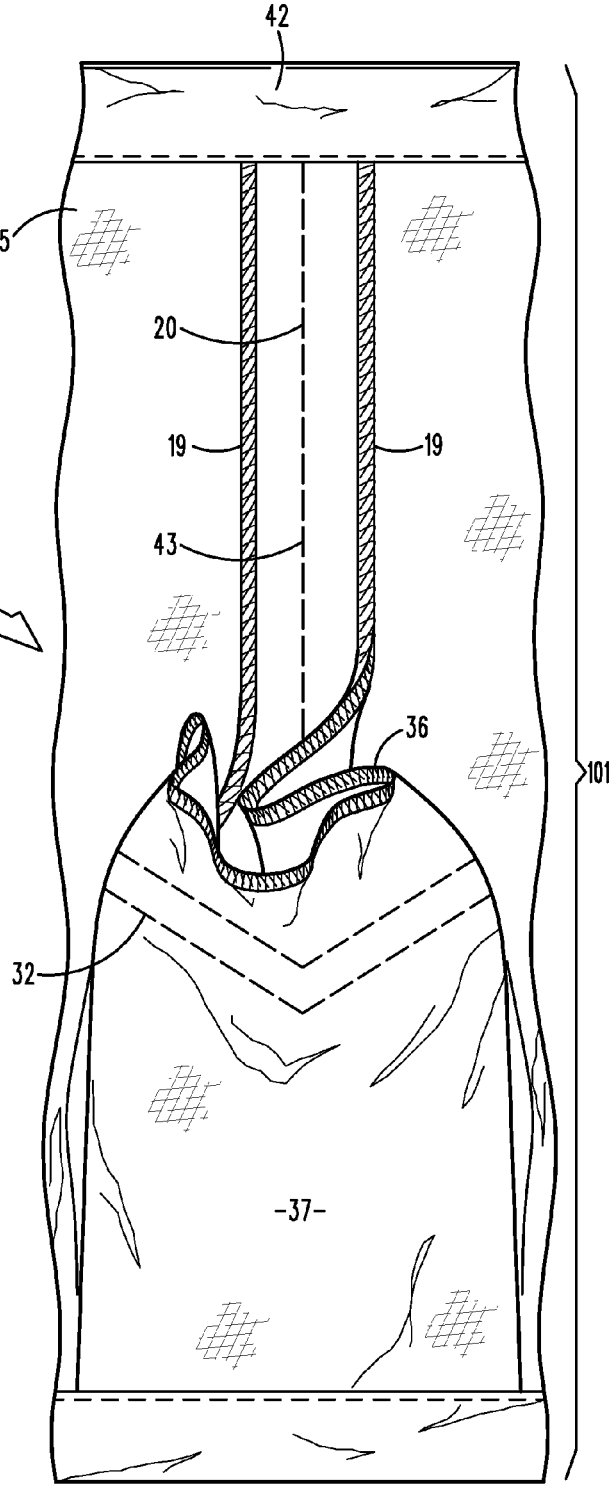
FIG. 7 is an enlarged fragmentary first view of a corner pleat section depicting the reverse or hidden side of the corner section.
Figure 8:
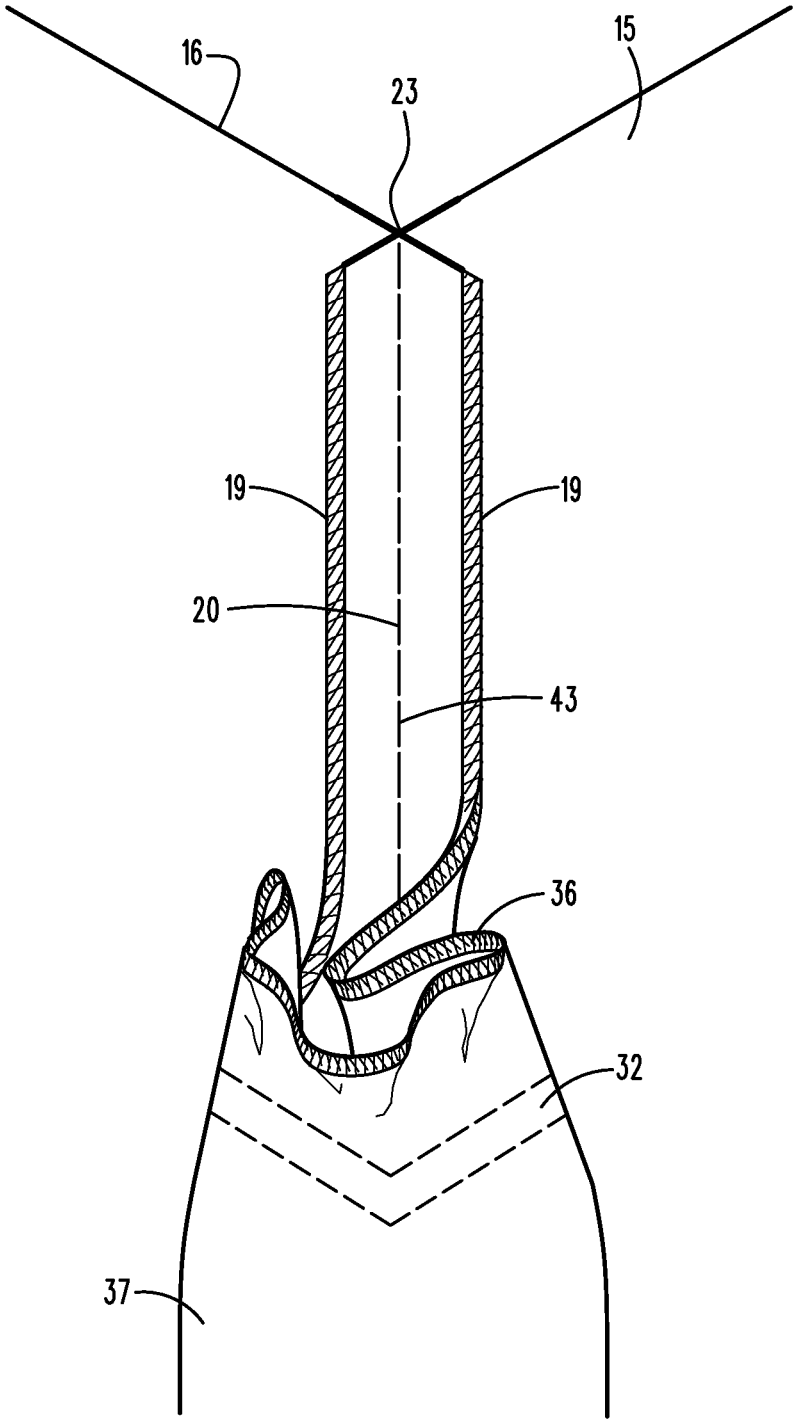
FIG. 8 is an enlarged fragmentary second view of a corner pleat section depicting the reverse or hidden side of the corner section.
Figure 9:
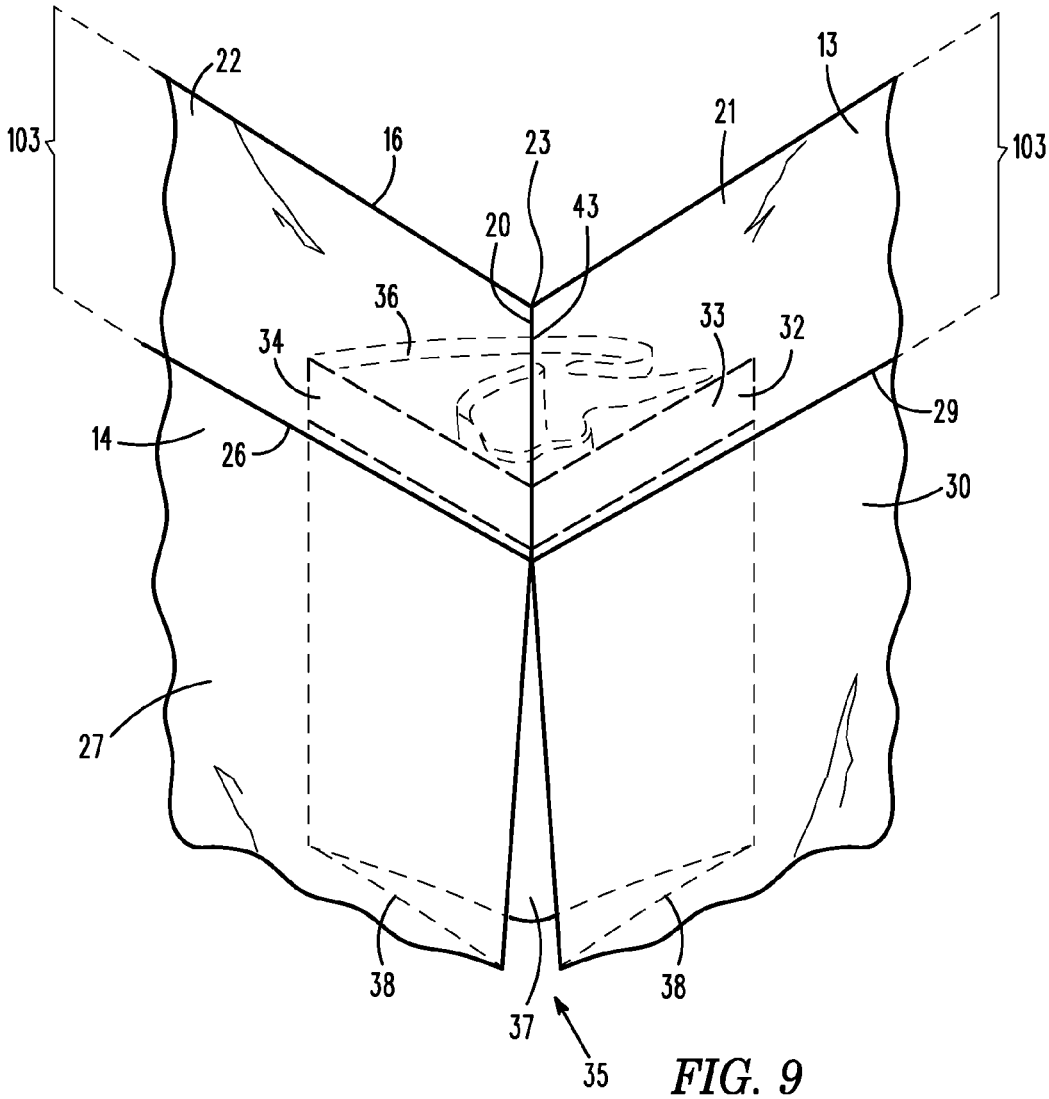
FIG. 9 is an enlarged, fragmentary sectional view of a corner pleat/mitered corner section of the bed skirt construction according to the present invention depicting hidden structures.

The bed skirt construction 10 according to the present invention preferably comprises or is constructed from a primary fabric panel 15 of predetermined length as at 100 and width as at 101. The fabric panel 15 preferably comprises a top edge 16 and pair of isosceles triangular cutouts 17 extending into the width 101 from the top edge 16. Each cutout 17 defines a vertex as at 18, and obliquely opposed edges as at 19, which edges 19 extend from the vertex 18 to the top edge 16 as generally depicted in FIG. 5.

The respective obliquely opposed edges 19 are preferably stitched or fastened together at corner seams 20 for forming opposed upper side panel portions as at 21, and an upper foot panel portion 22 extending intermediate the upper side panel portions 21. In other words, the upper side and foot panel portions 21 and 22 junction at the corner seams 20.

The corner seams 20 each have a top edge terminus as at 23 and a panel width terminus as at 24, which panel width termini 24 are commensurate with the vertices 18. The panel width termini 24 form a pair of corner vertices 25 with a foot panel line or crease or fold 26 extending therebetween. The foot panel line or crease 26 essentially separates or marks the boundary between the upper foot panel portion 22 from a lower foot panel portion as at 27.

A first side panel line or crease or fold as at 28, and a second side panel line or crease or fold as at 29 extend from the corner vertices 25 orthogonal to the foot panel line 26 and parallel to the top edge 16 for separating or marking the boundary between the upper side panel portions 21 and opposed lower side panel portions as at 30.

The bed skirt construction 10 may thus be outfitted upon a box spring 12 such that the lower side panel portions 30 conceal side portions of the box spring 12, and the lower foot panel portion 27 conceals a foot portion of the box spring 12. Further, the upper side panel portions 21 and the upper foot panel portion 22 extend in a mattress-to-spring interface plane as at 102 in superior adjacency to the box spring 12, and in inferior adjacency to the mattress 11.

It is apparent that the prior art relating to bed skirt construction fails to address the need for a quick, easy, clean, crisp, neat skirt fit at the corners of a box spring 12. The present invention attempts to address this need by providing for enhanced corner construction so that the interface plane 102 of the upper side and foot panel portions 21 and 22 is substantially orthogonal to the lower side and foot panel portions 30 and 27 at the foot corners.

Figure 10:
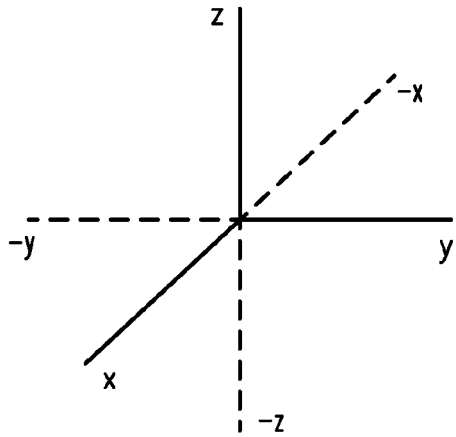
FIG. 10 is a diagrammatic depiction of a generic Cartesian coordinate system.

Referencing FIG. 10, the reader will note that three axial planes (X=0, Y=0, Z=0) divide space into eight equal octant domains, each with coordinate signs from (−, −, −) to (+, +, +). Usually, the octant with all three positive coordinates is referred to as the first octant. While there is no generally used naming convention for the other seven octants, the following table shall suffice to name the octants for the purposes of the present discussion.

| Number | Name | X | Y | Z |
|---|---|---|---|---|
| I | top-front-right | + | + | + |
| II | top-back-right | − | + | + |
| III | top-back-left | − | − | + |
| IV | top-front-left | + | − | + |
| V | bottom-front-right | + | + | − |
| VI | bottom-back-right | − | + | − |
| VII | bottom-back-left | − | − | − |
| VIII | bottom-front-left | + | − | − |

The reader may well envision the interface plane 102 generally extending or lying in the X-Y plane. A first or left corner vertex 25(L) may be envisioned/positioned at the (0, 0, 0) reference point such that a first lower side panel 30 extends in the ⁻X-Z plane and the lower foot panel portion 27 extends in the Y-Z plane, the box spring 12 thereby occupying Octant VI or the bottom-back-right octant, the mattress 11 thereby occupying Octant II or the top-back-right octant, with the interface plane 102 extending therebetween. In this scenario, the corner vertex 25(L) of the bed skirt construction attempts to achieve a perfect fit or perfectly orthogonal corner at the (0, 0, 0) reference point.

Shifting focus, a second or right corner vertex 25(R) may be envisioned/positioned at the (0, 0, 0) reference point such that a second lower side panel 30 extends in the ⁻X-Z plane and the lower foot panel portion 27 extends in the Y-Z plane, and the box spring 12 thereby occupying Octant VII or bottom-back-left octant, the mattress 11 thereby occupying Octant III or the top-back-left octant, with the interface plane 102 extending therebetween. In this scenario, the corner vertex 25(R) of the bed skirt construction 10 attempts to achieve a perfect fit or perfectly orthogonal corner at the (0, 0, 0) reference point.

Central to the practice of the present invention, and key to forming the perfectly orthogonal corners, are mitered joints 32 according to the bed skirt construction 10, which mitered joints 32 extend from the corner vertices 25(L) and 25(R) in the interface plane 102. It is contemplated that the mitered joints 32 according to the present invention essentially function to enhance positioned placement of the bed skirt construction 10 as outfitted atop or upon the box spring 12, and form orthogonal corners at the corner vertices 25(L) and 25(R).

Each mitered joint 32 preferably comprises a side panel extension as at 33, and a foot panel extension as at 34. The side panel extensions 33 respectively extend parallel to the side panel lines 28 and 29 and the foot panel extensions 34 extend parallel to the foot panel line 26. The side panel and foot panel extensions 33 and 34 are preferably right trapezoidal in form, having one oblique side or edge at the corner seam 20. The mitered joints 32 are preferably formed by stitching the fabric panel 15 substantially as collectively depicted in FIGS. 2(*c*), 2(*d*), 5, 7, and 8.

From an inspection of FIGS. 2(*c*) and 2(*d*), for example, it will be seen that the side panel extensions 33 and foot panel extensions 34 of the mitered joints 32 comprise a uniform thickness as at 106 such that the edges 50 of the extensions 33, and the edges 51 of the extensions 34 are respectively parallel to the lines or creases 28 and 29. Further, the edges 52 are parallel to the line or crease 26, and the edges 53 are respectively parallel to the lines or creases 28 and 29.

The mitered joints 32 are formed at the site of the triangular cutouts 17, which cutouts 17 are preferably right isosceles triangular cutouts 17 for forming the upper side panel portions 21 and the upper foot panel portion 22 so as to have a uniform panel width as at 103, and further for forming the upper foot panel portion 22 orthogonally relative to the upper side panel portions 21. The space of the cutouts 17 is closed as at arrows 104 and fabric panel 15 is preferably stitched adjacent the edges 19 to form the corner seam 20.

Corner pleats 35 preferably extend from the mitered joints 32. The corner pleats 35 are formed by gathering material of the fabric panel 15 into folds 36 and forming the mitered joint 32 via stitching through the folds 36 such that the corner pleat 35 comprises a primary pleat portion as at 37, and opposed secondary or folded pleat portions as at 38. The lower side panel portions 30 and the foot panel portion 27 each also preferably comprise at least one pleat as at 39 having an analogous primary pleat portion 37, and secondary or folded pleat portions 38.

Each pleat 39 comprises an upper pleat terminus or closed portion terminus as at 40, which upper pleat termini or closed portion termini 40 respectively terminate in the side and foot panel lines 29 and 26 for maintaining linearity of the side and/or foot panel lines 29 and 26. The corner pleats 35 preferably comprise upper pleat termini or closed portion termini as at 41, which terminate at the corner vertices 25, the junctions for lines 29 and 26. It is contemplated that the pleats 35 and 39, comprising both an upper closed portion and a lower open portion bound by the termini 40/41 help form and maintain crease lines 29 and 26, and thus essentially function to enhance positioned placement of the bed skirt construction 10 upon the box spring 12.

Bed skirts are typically constructed to either lay or tuck between a bed mattress and a box spring combination. Tuck type bed skirt pleats are somewhat problematic insofar as they are easily deformed, and thus continuously in need of readjustment. A crisp, neat appearance is thus difficult to maintain. The pleats 35 and 39 according to the present invention address this problem and, additionally, provide certain gauge means for how far to tuck the bed skirt construction 10 between the mattress 11 and box spring 12.

Typically, a tucked box pleat is open (i.e. not stitched or sewn closed at any point) from the top of its tucked beginning point to its bottom. This design flaw enables the problems described. The pleats 35 and 39 are stitched or sewn together as at 43 from their beginning point to the point where they meet the outside edge of the box spring 12 (i.e. lines 26 and 29). At this point, the pleats 35 and 39 open as a Stay Perfect Pleat, staying in place, never requiring adjustment and maintaining a crisp, neat appearance.

The bed skirt construction 10 according to the present invention further contemplates certain capping means as preferably defined by a cap assembly or tuck/grip welt assembly as at 42. The cap assembly 42 preferably comprises a fabric fold as at 63, and a cord member 44 receivable in the fabric fold 63.

The fabric fold 63 is fastened, stitched or sewn as at 45 to the top edge 16 thereby forming a top edge terminus 46 at the upper side panel portions 21 and the upper foot panel portion 22. The cap assembly 42, mitered corners 32, and Stay Perfect Pleats 35/39 together enhance positioned placement of the bed skirt construction 10 upon the box spring 12.

The capping means essentially function to join the upper side panel portions 21 to the upper foot panel portion 22 and to provide a bed-to-spring friction enhancing mechanism such that when the mattress 11 rests upon the capping means, the mattress weight (force) 110 bearing down on the capping means functions to prevent lateral displacement as at 111 of the capping means particularly and the bed skirt 10 generally within the interface plane 102 relative to the direction of the force 110.

The cord 44 that is used to frictionally hold the bed skirt 10 in place between the box springs 12 and the (plane 106 of the) mattress 11 is placed adjacent the connection between the capping means and the panel portions 21 and 22. The cord 44 used in the bed skirt 10 can be made from a variety of different materials and in a variety of different diameters, with the preferred diameter being in the range of from about 8⁄32 inches to about 12⁄32 inches.

The cord 44 is received in a pocket formed by the folded portion 63 holding the cord 44 in place. The capping means are thus sandwiched intermediate the box spring 12 and the mattress 11 as a friction means for frictionally maintaining the position of the bed skirt 10 in relation to the box spring 12 and mattress 11. The frictional engagement is formed by the diameter of the cord 44 within the capping means making an indentation as at 60 in the box spring 12 and mattress 11 as generally depicted in FIG. 1(*c*) that creates a resistance against movement (as at 112) of the bed skirt 10.

While the above description contains much specificity, this specificity should not be construed as limitations on the scope of the invention, but rather as an exemplification of the invention. For example, it is contemplated that the present invention essentially provides a bed skirt construction comprising a fabric panel of predetermined length and width. The fabric panel comprises a top edge as at 16 and opposed sets of opposed corner edging (e.g. edges 19) extending from the top edge 16 into the width 101.

The sets of opposed corner edging are respectively fastened together for forming corner seams as at 20, which corner seams separate or bound the upper side panel portions 21 from an upper foot panel 22 portion extending intermediate the upper side panel portions 21. The corner seams each have a top edge terminus as at 23, and a panel width terminus as at 24. The panel width termini 24 form a pair of corner vertices as at 25 with a foot panel line 26 extending therebetween.

The foot panel line or crease or fold 26 separates the upper foot panel portion 22 from a lower foot panel portion as at 27. The side panel lines 28 and 29 extend from the corner vertices 25 orthogonal to the foot panel line 26 parallel to the top edge 16 for separating the upper side panel portions 21 from a pair of lower side panel portions as at 30.

The bed skirt construction 10 may thus be outfitted upon a box spring 12 such that the lower side panel portions 30 conceal side portions of the box spring 12, and the lower foot panel portion 27 conceals a foot portion of the box spring 12. The upper side and foot panel portions 21 and 22 extend in a mattress-to-spring interface plane 102 in superior adjacency to an upper plane 105 of the box spring 12 inferior to the mattress 11.

The bed skirt construction 10 preferably further comprises a pair of mitered joints 32 that extend from the corner vertices in the interface plane. The mitered joints 32 enhance positioned placement of the bed skirt construction upon the box spring. Each mitered joint 32 preferably comprises a side panel extension as at 33 and a foot panel extension as at 34. The side panel extensions extend parallel to the side panel lines and the foot panel extensions extend parallel to the foot panel line. The side panel and foot panel extensions are preferably right trapezoidal for maintaining the right angled corner construction/fit.

The bed skirt construction further preferably comprises certain capping means as exemplified by cap assembly 42. The cap assembly 42 comprises a fabric fold 63 and a cord member 44 receivable in the fabric fold 63. The fabric fold 63 is fastened to the top edge 16 thereby forming a top edge terminus at the upper side and foot panel portions. Together, the cap assembly 42 and mitered corners or joints 32 enhance positioned placement of the bed skirt construction 10 upon the box spring 12.

Certain so-called Stay Perfect Pleats are further incorporated into the construction 10, and function to enhance the positioned placement and appearance of the bed skirt when outfitted upon a box spring 12. In this regard, for example, it is contemplated that the lower side and foot panel portions 30 and 27 may each preferably comprise at least one pleat as at 39. Each pleat 39 preferably comprises an upper pleat terminus, which upper pleat termini respectively terminate in side and foot panel lines for enhancing positioned placement of the bed skirt construction 10 upon a box spring 12.

It is contemplated that the foregoing specifications further support a bed skirt manufacture method comprising a series of steps, including the formation of a fabric panel as at 15 of predetermined length and width. The formed fabric panel is formed to comprise a top edge and two sets of corner edging extending from the top edge into the width intermediate the length.

The sets of corner edging are respectively fastened thereby forming corner seams. The corner seams separate upper side panel portions from an upper foot panel portion extending intermediate the upper side panel portions. The corner seams each have a top edge terminus and a panel width terminus, the panel width termini forming a pair of corner vertices with a foot panel line extending therebetween.

The foot panel line separates the upper foot panel portion from a lower foot panel portion, and first and second side panel lines extend from the corner vertices orthogonal to the foot panel line and parallel to the top edge for separating the upper side panel portions from a pair of lower side panel portions. The upper side and foot panel portions extend in an interface plane, and the lower side and foot panel portions extending in lower panel planes orthogonal the interface plane.

The bed skirt manufacture method further comprises the step of forming a pair of mitered joints adjacent the corner vertices, which mitered joints extend into the upper side and foot panel portions for maintaining the lower panel planes and interface plane in orthogonal relationship to one another.

Accordingly, although the invention has been described by reference to certain preferred embodiments, and certain methodology, it is not intended that the bed skirt construction herein presented be limited thereby, but that modifications thereof are intended to be included as falling within the broad scope and spirit of the foregoing disclosure, the following claims and the appended drawings.

I claim:

1. A bed skirt construction for use with a bed having a mattress and a box spring, the bed skirt construction comprising:

a fabric panel of predetermined length and width, the fabric panel comprising a top edge and pair of cutouts extending into the width from the top edge, each cutout defining a vertex and obliquely opposed edges extending from the vertex to the top edge, the respective obliquely opposed edges being fastened together at corner seams for forming opposed upper side panel portions and an upper foot panel portion extending intermediate the upper side panel portions, the corner seams each having a top edge terminus and a panel width terminus, the panel width termini forming a pair of corner vertices with a foot panel line extending therebetween, the foot panel line separating the upper foot panel portion from a lower foot panel portion, first and second side panel lines extending from the corner vertices orthogonal to the foot panel line and parallel to the top edge for separating the upper side panel portions from a pair of lower side panel portions, a pair of mitered joints extending in the interface plane in spaced relation to the corner vertices, each mitered joint comprising a side panel extension and a foot panel extension, the side panel extensions respectively extending parallel to the side panel lines, and the foot panel extensions extending parallel to the foot panel line, the side panel and foot panel extensions being right trapezoidal in form, and thus having one oblique side or edge at said corner seams, the mitered joints for maintaining orthogonality at the corner vertices and enhancing positioned placement of the bed skirt construction atop a box spring, the bed skirt construction being outfittable upon the box spring such that the lower side panel portions conceal side portions of the box spring, and the lower foot panel portion conceals a foot portion of the box spring, the upper side and foot panel portions thus for extending in a mattress-to-spring interface plane in superior adjacency to the box spring.

2. The bed skirt construction of claim 1 wherein each mitered joint comprises a side panel extension and a foot panel extension.

3. The bed skirt construction of claim 2 wherein the side panel extensions extend parallel to the side panel lines and the foot panel extensions extend parallel to the foot panel line.

4. The bed skirt construction of claim 3 wherein the side panel and foot panel extensions are trapezoidal.

5. The bed skirt construction of claim 4 wherein the side panel and foot panel extensions are right trapezoidal.

6. The bed skirt construction of claim 1 wherein the cutouts are right isosceles triangular cutouts, the right isosceles triangular cutouts for forming upper side and foot panel portions of uniform panel width and for forming the upper foot panel portion orthogonally relative to the upper side panel portions.

7. The bed skirt construction of claim 1 comprising a cap assembly, the cap assembly comprising a fabric fold and a cord member receivable in the fabric fold, the fabric fold for fastened attachment to the top edge thereby forming a top edge terminus at the upper side and foot panel portions, the cap assembly providing lateral displacement prevention means intermediate the box spring and a weighty mattress as received thereupon and thus for enhancing positioned placement of the bed skirt construction upon the box spring.

8. The bed skirt construction of claim 1 wherein the lower side and foot panel portions each comprise at least one pleat, each pleat comprising an upper closed portion, a lower open portion, and a closed pleat terminus, the closed pleat termini respectively terminating in the side and foot panel lines, the side and foot panel lines for aiding functional tucked placement of the bed skirt construction and for maintaining aesthetic linearity of the side and foot panel lines together for enhancing positioned placement of the bed skirt construction upon the box spring.

9. A bed skirt construction, the bed skirt construction comprising:

a fabric panel of predetermined length and width, the fabric panel comprising a top edge and opposed sets of opposed corner edging extending from the top edge into the width, the sets of opposed corner edging being respectively fastened together for forming corner seams, the corner seams separating upper side panel portions from an upper foot panel portion extending intermediate the upper side panel portions, the corner seams each having a top edge terminus and a panel width terminus, the panel width termini forming a pair of corner vertices with a foot panel line extending therebetween, the foot panel line for separating the upper foot panel portion from a lower foot panel portion, first and second side panel lines extending from the corner vertices orthogonal to the foot panel line and parallel to the top edge for separating the upper side panel portions from a pair of lower side panel portions, a pair of mitered joints extending in the interface plane in spaced relation to the corner vertices, each mitered joint comprising a side panel extension and a foot panel extension, the side panel extensions respectively extending parallel to the side panel lines, and the foot panel extensions extending parallel to the foot panel line, the mitered joints for maintaining orthogonality at the corner vertices and enhancing positioned placement of the bed skirt construction atop a box spring, the bed skirt construction being outfittable upon a box spring such that the upper side and foot panel portions extend in a mattress-to-spring interface plane.

10. The bed skirt construction of claim 9 wherein the cutouts are right isosceles triangular cutouts, the right isosceles triangular cutouts for forming upper side and foot panel portions of uniform panel width and for forming the upper foot panel portion orthogonally relative to the upper side panel portions.

11. The bed skirt construction of claim 9 wherein the side panel and foot panel extensions of the mitered joints are right trapezoidal in form, and thus each have one oblique side or edge at said corner seams, the right trapezoidal side and foot panel extension of the mitered joints for enhancing orthogonality at the corner vertices and thus for enhancing positioned placement of the bed skirt construction upon the box spring.

12. The bed skirt construction of claim 10 wherein each mitered joint comprises a side panel extension and a foot panel extension.

13. The bed skirt construction of claim 9 comprising capping means, the capping means for fastened attachment to the top edge thereby forming a top edge terminus at the upper side and foot panel portions, the capping means for enhancing positioned placement of the bed skirt construction upon the box spring.

14. The bed skirt construction of claim 9 comprising opposed corner pleats, each corner pleat comprising a closed pleat terminus, the closed pleat termini respectively terminating at the corner vertices in the side and foot panel lines for aiding functional tucked placement of the bed skirt construction and for maintaining aesthetic linearity of the side and foot panel lines together for enhancing positioned placement of the bed skirt construction upon the box spring.

15. The bed skirt construction of claim 9 wherein the lower side and foot panel portions each comprise at least one pleat, each pleat comprising a closed upper pleat portion and an open lower pleat portion bound by a closed upper pleat terminus, the closed upper pleat termini for aiding functional tucked placement of the bed skirt construction and for maintaining aesthetic linearity of the side and foot panel lines together for enhancing positioned placement of the bed skirt construction upon the box spring.

16. A bed skirt manufacture method, the method comprising the steps of:

forming a fabric panel of predetermined length and width, the fabric panel comprising a top edge and two sets of corner edging extending from the top edge into the width intermediate the length;

respectively fastening the sets of corner edging thereby forming corner seams, the corner seams separating upper side panel portions from an upper foot panel portion extending intermediate the upper side panel portions, the corner seams each having a top edge terminus and a panel width terminus, the panel width termini forming a pair of corner vertices with a foot panel line extending therebetween, the foot panel line for separating the upper foot panel portion from a lower foot panel portion, first and second side panel lines extending from the corner vertices orthogonal to the foot panel line and parallel to the top edge for separating the upper side panel portions from a pair of lower side panel portions, the upper side and foot panel portions for extending in an interface plane, the lower side and foot panel portions for extending in lower panel planes orthogonal the interface plane, a pair of mitered joints being formed in the interface plane extending in spaced relation to the corner vertices, each mitered joint comprising a side panel extension and a foot panel extension, the side panel extensions respectively extending parallel to the side panel lines, and the foot panel extensions extending parallel to the foot panel line, the mitered joints for maintaining orthogonality at the corner vertices and enhancing positioned placement of the bed skirt construction atop a box spring.

17. The bed skirt manufacture method of claim 16 comprising the step of forming a pair of mitered joints adjacent the corner vertices, the mitered joints extending into the upper side and foot panel portions for maintaining the lower panel planes and interface plane in orthogonal relationship to one another.

18. The bed skirt manufacture method of claim 16 comprising the step of attaching capping means to the top edge, the capping means for enhancing positioned placement of the manufactured bed skirt upon a box spring.

19. The bed skirt manufacture method of claim 16 comprising the step of forming at least one pleat in the fabric panel, the formed pleat comprising a closed portion and an open portion bound by a closed pleat terminus, the open portion extending from a select panel line, the closed pleat terminus lying in the select panel line for maintaining linearity of the select line, the select panel line being selected from the group consisting of the foot panel line and the side panel lines.

* * * * *